US007744082B2

(12) United States Patent
Iwami et al.

(10) Patent No.: US 7,744,082 B2
(45) Date of Patent: Jun. 29, 2010

(54) PAPER-SHEET FEEDING DEVICE WITH KICKER ROLLER

(75) Inventors: Toyofumi Iwami, Himeji (JP); Hidehiko Matsushita, Takasago (JP)

(73) Assignee: Glory Ltd., Himeji-Shi (JP)

( * ) Notice: Subject to any disclaimer, the term of this patent is extended or adjusted under 35 U.S.C. 154(b) by 82 days.

(21) Appl. No.: 11/917,156

(22) PCT Filed: Jun. 14, 2005

(86) PCT No.: PCT/JP2005/010839

§ 371 (c)(1),
(2), (4) Date: Dec. 11, 2007

(87) PCT Pub. No.: WO2006/134637

PCT Pub. Date: Dec. 21, 2006

(65) Prior Publication Data

US 2009/0026692 A1 Jan. 29, 2009

(51) Int. Cl.
*B65H 3/06* (2006.01)

(52) U.S. Cl. ..... 271/119

(58) Field of Classification Search ..... 271/119
See application file for complete search history.

(56) References Cited

U.S. PATENT DOCUMENTS 3,857,559 A * 12/1974 McInerny ..... 271/122
4,494,747 A 1/1985 Graef et al.
4,715,593 A * 12/1987 Godlewski ..... 271/119
4,958,825 A * 9/1990 Onomoto et al. ..... 271/119
4,991,831 A * 2/1991 Green ..... 271/121

FOREIGN PATENT DOCUMENTS

| | | | |
|---|---|---|---|
| EP | 0 393 589 | A1 | 10/1990 |
| JP | 62-280141 | A1 | 12/1987 |
| JP | 04-292340 | A1 | 10/1992 |
| JP | 05-319592 | A1 | 12/1993 |
| JP | 05319592 | A * | 12/1993 |
| JP | 11-124266 | S1 | 5/1999 |
| JP | 2003-155128 | A1 | 5/2003 |

* cited by examiner

*Primary Examiner*—Patrick Mackey
*Assistant Examiner*—Gerald W McClain
(74) *Attorney, Agent, or Firm*—Burr & Brown

(57) ABSTRACT

A paper-sheet feeding device including a kicker roller configured to contact a forefront paper-sheet of a plurality of stacked paper-sheets and kick out the forefront paper-sheet; a feed roller to feed-out the paper-sheets to be kicked out by the kicker roller; and a press-fitting roller press-fit against the feed roller to provide a gate unit adapted to separate the paper-sheets to be fed by the feed roller, into one sheet. The kicker roller includes a base part and a high friction part formed in part of the outer circumference of the base part along the circumferential direction and configured to kick out the forefront paper-sheet. The feed roller includes a base part and a high friction part formed over the entire outer circumference of the base part and configured to contact the surface of the paper-sheet to be kicked out by the kicker roller to perform feed-out of the paper-sheet.

5 Claims, 6 Drawing Sheets

PAPER-SHEET FEEDING DEVICE WITH KICKER ROLLER

FIELD OF THE INVENTION

The present invention relates to a paper-sheet feeding device adapted to feed a plurality of paper-sheets held in a stacked state, to the outside, successively, one sheet for each operation.

BACKGROUND ART

The paper-sheet feeding device for use in a banknote counter or the like is constructed to feed paper-sheets (e.g., banknotes or the like) stored therein in a stacked state, successively, one sheet for each operation, so as to carry them to the outside.

For instance, as disclosed in JP62-280141A and JP2003-155128A, the paper-sheet feeding device of this type generally comprises a kicker roller and a feed roller, each having a high friction part formed on the outer circumferential face thereof, in order to kick out and carry out a plurality of paper-sheets held in a stacked state, one sheet for each operation. A gate unit (or reversal roller) is provided to be opposed to the feed roller, in which a gate part is provided between the feed roller and the gate unit, in order to pass only one of the paper-sheets therethrough during each feed operation and prevent feeding the one paper-sheet together with a second or more later paper-sheets at a time.

In such a paper-sheet feeding device, however, in the case of changing denominations of paper-sheets to be fed, the gate part must be adjusted depending on the thickness and/or strength of rigidness of the paper-sheets to be changed. Additionally, for banknotes of various countries differing in the thickness and/or strength of rigidness, for example, it is sometimes difficult to adjust the gate part appropriately.

SUMMARY OF THE INVENTION

The present invention was made in view of the above challenges. It is therefore an object of this invention to provide a paper-sheet feeding device, which can securely feed various sorts and/or denominations of paper-sheets, e.g., banknotes of various countries, having various thickness and strength of rigidness, one sheet for each operation, without feeding it together with a second or more later ones at a time, thus enabling to provide secure counting of the number of paper-sheets to be fed.

The paper-sheet feeding device of the present invention comprises: a kicker roller configured to be in contact with the surface of a forefront paper-sheet of a plurality of paper-sheets held in a stacked state, adapted to be rotated continuously upon performing feed-out of the paper-sheets, and including a base part and a high friction part formed in a part of the outer circumference of the base part along the circumferential direction and configured to kick out the forefront paper-sheet; a feed roller adapted to be rotated continuously upon performing the feed-out of the paper-sheets, and including a base part and a high friction part formed over the entire outer circumference of the base part and configured to be in contact with the surface of the paper-sheet to be kicked out by the kicker roller so as to perform the feed-out of the paper-sheet; and a press-fitting roller provided to press-fit against the feed roller so as to provide a gate part between the press-fitting roller and the feed roller, the gate part being adapted to separate the paper-sheets to be fed by the feed roller, into one sheet.

According to the paper-sheet device of this invention, the paper-sheets held in a stacked state can be kicked out, securely and successively, one sheet for each operation, by utilizing the kicker roller, without being subjected to any effect due to the thickness and/or strength of rigidness of each paper-sheet. Thereafter, by passing the paper-sheets through the press-fitting type gate part, they can be carried out, securely and successively, one sheet for each operation, without being subjected to any effect due to the thickness and/or strength of rigidness of each paper-sheet. Therefore, there should be no need for adjusting the gate part, corresponding to various sorts and/or denominations of paper-sheets, e.g., banknotes of various countries, having various thickness and strength of rigidness, and hence such paper-sheets can be fed, securely, one sheet for each operation, without feeding it together with a second or more later ones at a time, therefore enabling to perform secure counting of the number of paper-sheets to be fed.

In the paper-sheet feeding device according to this invention, it is preferred that the paper-sheet feeding device further comprises: a stopper provided in the vicinity of the kicker roller, such that the stopper can be advanced to and retracted from the forefront paper-sheet, wherein, when advanced, the stopper is actuated to press against the forefront paper-sheet so as to make the kicker roller be detached from the forefront paper-sheet, while when retracted, the stopper is actuated to make the kicker roller be in contact with the forefront paper-sheet; and a stopper-operating cam configured to be rotated synchronously with the kicker roller, and adapted to retract the stopper during a period of time, from a kicking out start timing at which the high friction part of the kicker roller starts to contact with at least the forefront paper-sheet to a kicking out end timing at which the forefront paper-sheet is kicked out and spaced apart from the high friction part of the kicker roller, as well as adapted to make the stopper advance during a period of time, from the kicking out end timing to a next kicking out start timing.

According to the above paper-sheet device, during the period of time the high friction part of the kicker roller is in contact with at least the forefront paper-sheet, the stopper is retracted, and hence the forefront paper-sheet is never locked by the stopper. On the other hand, during the period of time that the high friction part of the kicker roller is not in contact with the forefront paper-sheet, the stopper presses against the paper-sheet so as to lock the paper-sheet. Consequently, phenomena of feeding one paper-sheet together with a second or more later ones, at a time, due to the kicker roller, can be securely prevented.

In the paper-sheet feeding device according to this invention, it is preferred that the base part of the kicker roller is depressed at its one or both edge portions in the width direction, relative to its central portion, at least in the vicinity of the high friction part, such that there is substantially no difference in levels between the central portion of the base part and the high friction part, at a boundary point between the base part and the high friction part in the outer circumference of the kicker roller, while some difference in levels is provided between the edge portions of the base part and the high friction part.

According to the above paper-sheet device, since there is substantially no difference in levels between the central portion of the base part and the high friction part at the boundary point, vibration of the paper-sheet to be generated upon starting the contact of the high friction part with the forefront paper held in a stacked state can be reduced. On the other hand, since there is some difference in levels between the edge portions of the base part and the high friction part at the boundary point, significant edge effect can be securely obtained upon kicking out the paper-sheet due to the high friction part.

In the paper-sheet feeding device according to this invention, it is preferred that the feed roller includes a protrusion part projecting further radially outward from the high friction part on one or both sides of the high friction part.

According to the above paper-sheet device, resistance to be caused upon the advancement of the paper-sheet into the gate part can be increased, thereby further securely preventing the feeding of a plurality of paper-sheets together at a time through the gate part. In addition, since the protrusion part projects further radially outward from the high friction part, failure of feeding at the gate part will not occur, even in the case where the paper-sheet to be carried through the gate part is an unusual one, for example, those having a folded distal end or the like.

In the paper-sheet feeding device according to this invention, it is preferred that the paper-sheet feeding device further comprises a pusher, which is provided in the vicinity of the kicker roller and adapted to press backward an upper end of the forefront paper-sheet so as to keep the paper-sheets in a standing state.

According to the above paper-sheet device, since the pusher can press backward the upper end of the forefront paper-sheet so as to keep the paper-sheets in a standing state, the size of the gap to be created between the bottom end of the forefront paper-sheet and the feed roller can be lessened. Accordingly, jamming of the paper-sheet to be kicked out by the kicker rollers at the gap, and/or folding of the distal end of the paper-sheet at the gap, can be prevented. Additionally, since the point at which the pusher is in contact with the forefront paper-sheet is only the upper end portion thereof, the surface of the forefront paper-sheet will not be subjected to greater resistance from the guide unit, for example, thereby preventing the occurrence of failed feeding of the paper-sheets at the gate part.

DETAILED DESCRIPTION OF THE INVENTION

Hereinafter, one embodiment of the present invention will be described with reference to the drawings. FIGS. 1 to 10 respectively illustrate the embodiment in which a paper-sheet feeding device according to the present invention is applied to a paper-sheet storing and feeding device.

Now, the general construction, specific construction of each part, operation and effect, and modifications, of the paper-sheet storing and feeding device of this embodiment will be described, in succession.

Figure 1:
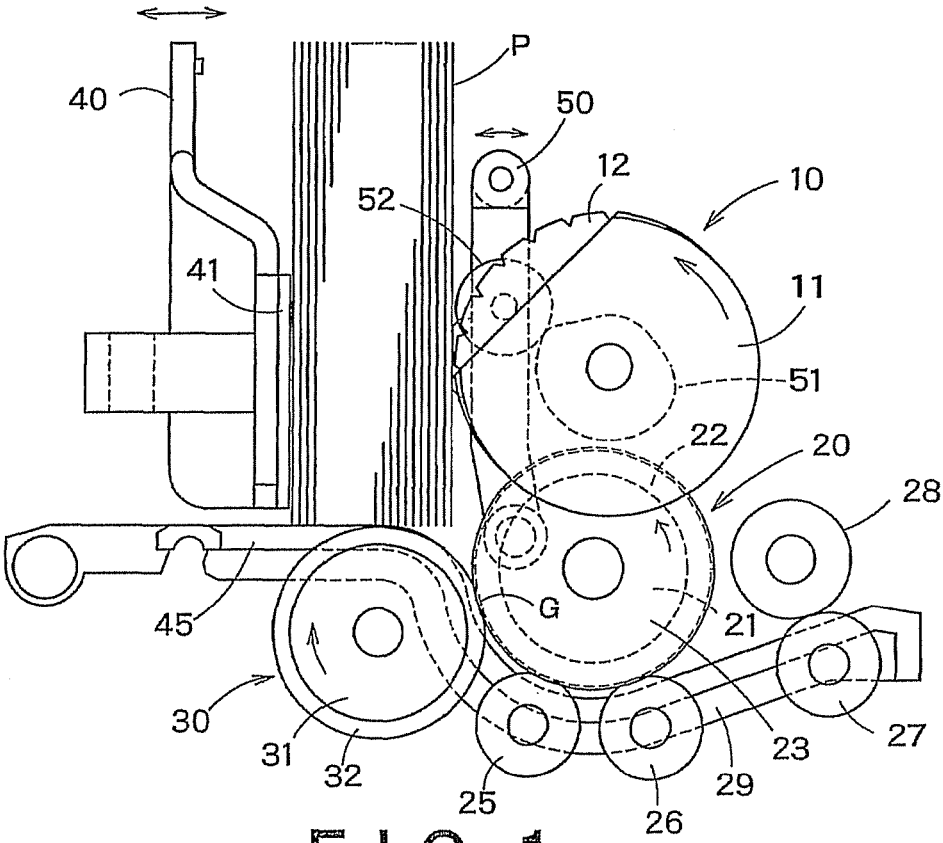
FIG. 1 is a side view showing a construction of a paper-sheet storing and feeding device according to one embodiment of the present invention.
Figure 2:
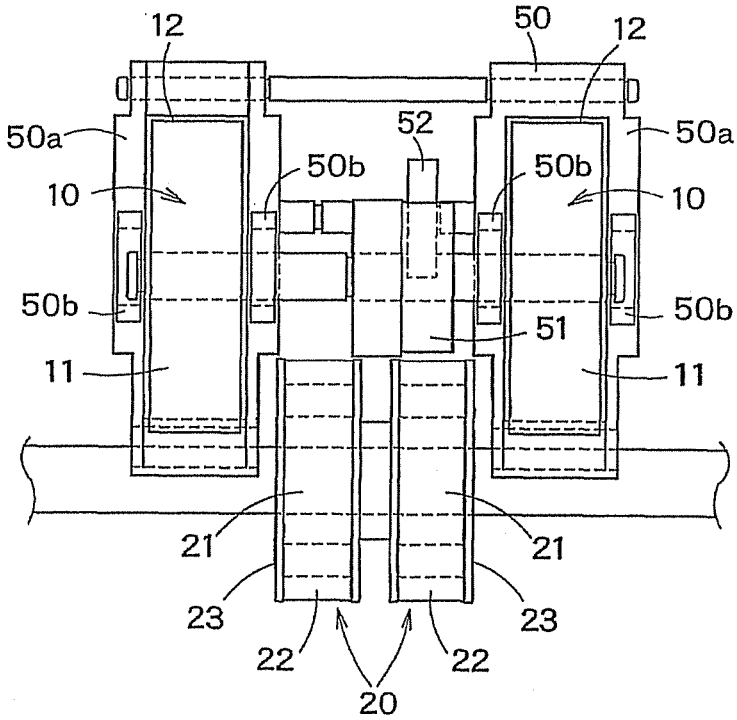
FIG. 2 is a front view showing a relation of arrangement of each roller in the paper-sheet storing and feeding device in FIG. 1.

As shown in FIGS. 1 and 2, the paper-sheet storing and feeding device includes a table 45 for placing a plurality of paper-sheets thereon in a standing state, and a pair of left and right kicker rollers 10 each adapted to contact with the surface of a forefront paper-sheet P of the plurality of paper-sheets (e.g., banknotes) stacked on the table 45 and then kick out the forefront paper-sheet P. In addition, a pair of left and right feed rollers 20 adapted to feed the paper-sheet P to be kicked out by the kicker rollers 10 and a pair of left and right press-fitting rollers 30 provided to press-fit against each feed roller 20 so as to provide a gate part G (or nip) between the press-fitting rollers 30 and the feed rollers 20 are provided below the kicker rollers 10. A paper-sheet holding unit 40 is provided above the table 45 in the vicinity of the kicker rollers 10 with a space. The paper-sheet holding unit 40 serves to hold the plurality of paper-sheets between the holding unit 40 and the kicker rollers 10 and keep these paper-sheets in a stacked standing state.

In the vicinity of kicker rollers 10, a stopper 50 is provided such that it can be advanced to and retracted from the forefront paper-sheet P held in a stacked state on the table 45. In addition, a stopper-operating cam 51 adapted to control the movement of the stopper 50 is provided coaxially with the kicker rollers 10.

A guide unit 29 adapted to guide the paper-sheet to be fed from the gate part G is provided below the feed rollers 20. A pair of left and right first grip rollers 25 and a pair of left and right second grip rollers 26 are in contact with the feed rollers 20, respectively, so as to further carry the paper-sheet P to be fed from the gate part G, due to cooperation of the first grip rollers 25, second grip rollers 26 and feed rollers 20. In the vicinity of the feed rollers 20, a pair of left and right third grip rollers 27 and a pair of left and right carrying out rollers 28, which are respectively in contact with the third grip rollers 27, are provided, so as to carry out the paper-sheet P to be fed from the nip between the feed rollers 20 and the second grip rollers 26 along the guide unit 29, due to cooperation of the third grip rollers 27 and carrying out rollers 28.

Now, each component of the paper-sheet storing and feeding device described above will be further detailed.

Figure 3:
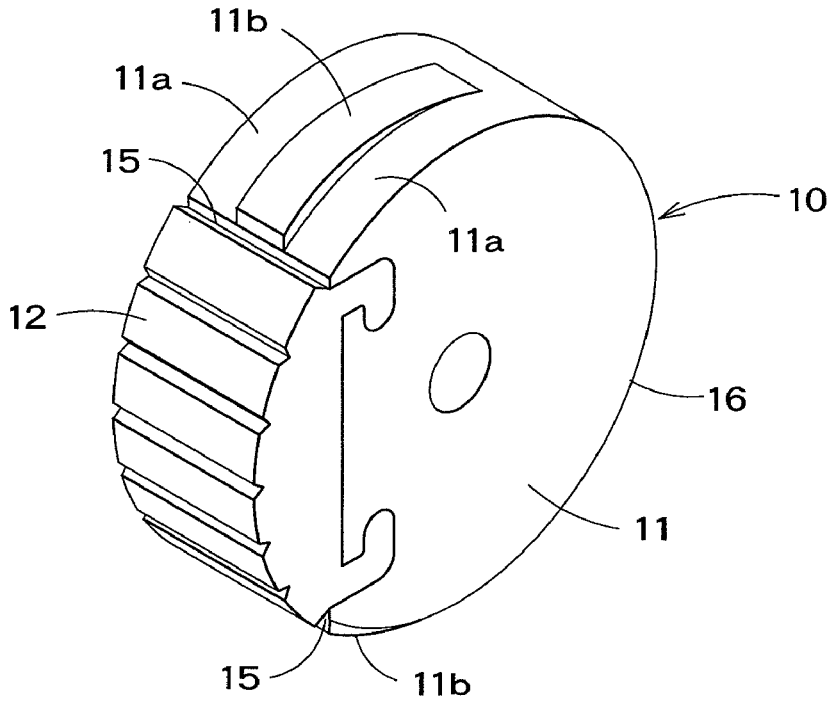
FIG. 3 is a perspective view showing details of a construction of a kicker roller in the paper-sheet storing and feeding device in FIG. 1.
Figure 4:
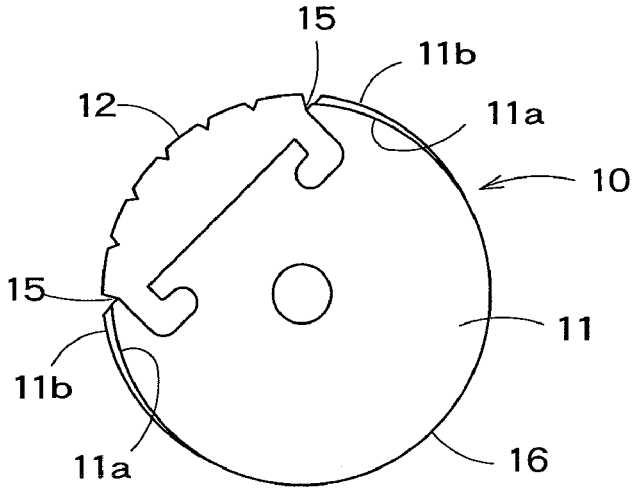
FIG. 4 is a side view of the kicker roller in FIG. 3.
Figure 5:
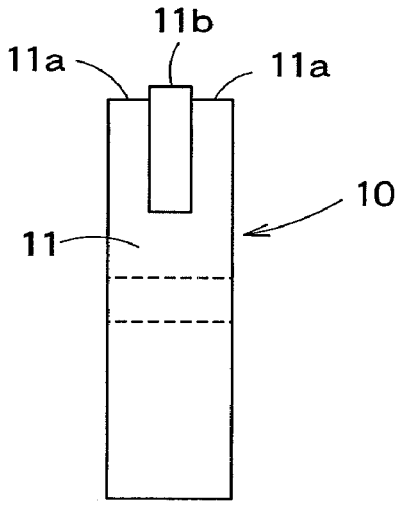
FIG. 5 is a front view of the kicker roller in FIG. 3.

The kicker rollers 10, as shown in FIG. 1, are in contact with the surface of the forefront paper-sheet P of the plurality of paper-sheets held in a stacked state, and is configured to rotate continuously in the direction depicted by an arrow shown in FIG. 1 upon feeding the paper-sheet P. Each kicker roller 10, as shown in FIGS. 3 to 5, includes a base part 11 having a substantially disk-like shape and formed from, for example, a plastic or metal, and a rubber (or high friction part) 12 formed in a part of the outer circumference of the base part 11 along the circumferential direction and adapted to kick out the forefront paper-sheet P. The rubber 12 is configured to cover about, for example, ¼, of the outer circumferential face of the base part 11.

The diameter of each kicker roller 10 is approximately 40 mm, for example, while the width is approximately 12 mm, for example.

The base part 11 of each kicker roller 10, as shown in FIGS. 3 to 5, is depressed at both edge portions 11*a* in the width direction, relative to a central portion 11*b*, at least in the vicinity of the rubber 12. The width of each edge portion 11*a* and that of the central portion 11*b* are each approximately 4 mm. Specifically, the depth (or difference in levels) of the edge portions 11*a* relative to the central portion 11*b* is the maximum at each boundary point 15 between the base part 11 and the rubber 12 in the outer circumference of each kicker roller 10. The depth of the depression is gradually decreased as one moves away from the boundary point 15 along the outer circumferential face of the base part 11, and the difference in levels between the edge portions 11*a* and the central portion 11*b* disappears at a point 16 opposite in the diametrical direction to an attachment point of the rubber 12 in the outer circumferential face of the base part 11.

In addition, as shown in FIGS. 3 and 4, at each boundary point 15 between the base part 11 and the rubber 12, there is substantially no difference in levels between the central portion 11*b* of the base part 11 and the rubber 12, while some difference in levels is provided between each edge portion 11*a* of the base part 11 and the rubber 12.

Figure 6:
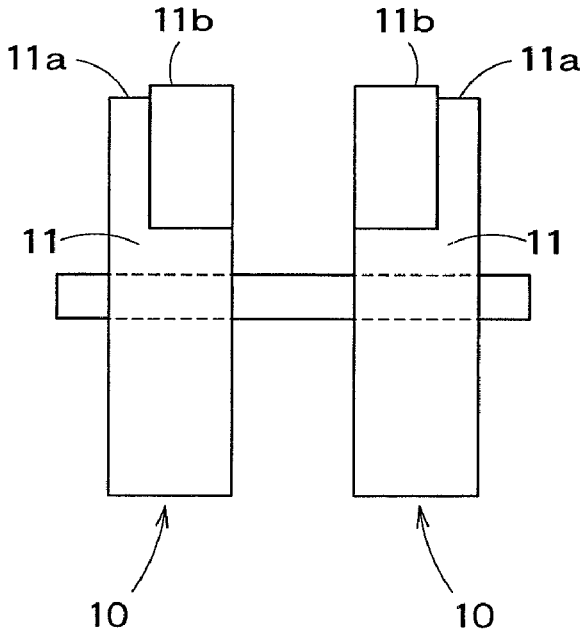
FIG. 6 is a front view showing another construction of a combined body of a pair of kicker rollers.

It should be noted that the depression or indentation is not limited to the aspect described above, i.e., the case in which both edge portions 11*a* in the width direction of the base part 11 are depressed relative to the central portion 11*b*. Namely, only one of the edge portions 11*a* may be depressed relative to the central portion 11*b*. Alternatively, as shown in FIG. 6, each base part 11 may be formed in a combined body of the pair of left and right kicker rollers 10, such that only the edge portions 11*a* provided on the respective outer peripheries in the combined body are depressed relative to the central portions 11*b*, respectively.

Each feed roller 20 is configured to be rotated continuously in the direction depicted by an arrow shown in FIG. 1 upon feeding the paper-sheet P. The feed roller 20 includes a base part 21 having a substantially disk-like shape and formed from, for example, a plastic or metal, and a rubber (or high friction part) 22 formed over the entire outer circumference of the base part 21. The rubber 22 is configured to be in contact with the surface of the paper-sheet P to be fed by the kicker rollers 10 and then feed the paper-sheet.

Figure 7:
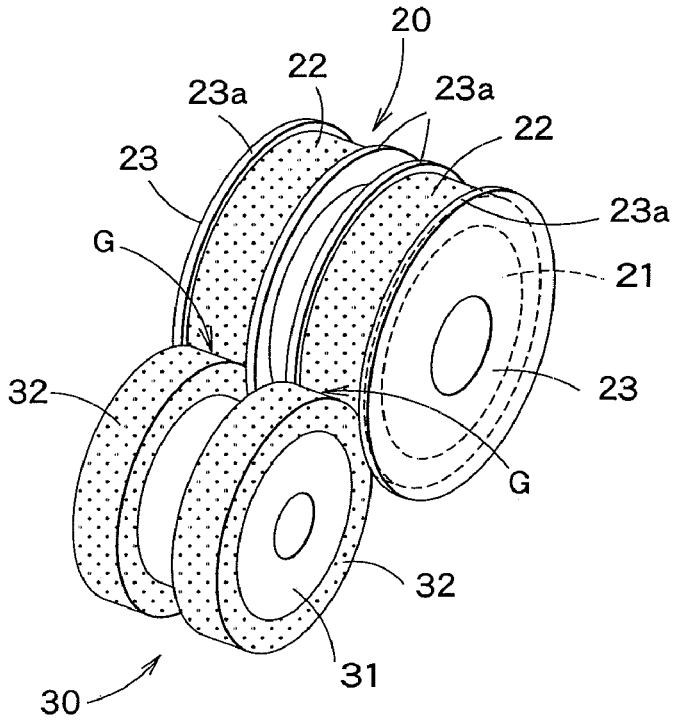
FIG. 7 is a perspective view showing details of a construction of a feed roller in the paper-sheet storing and feeding device in FIG. 1.
Figure 8:
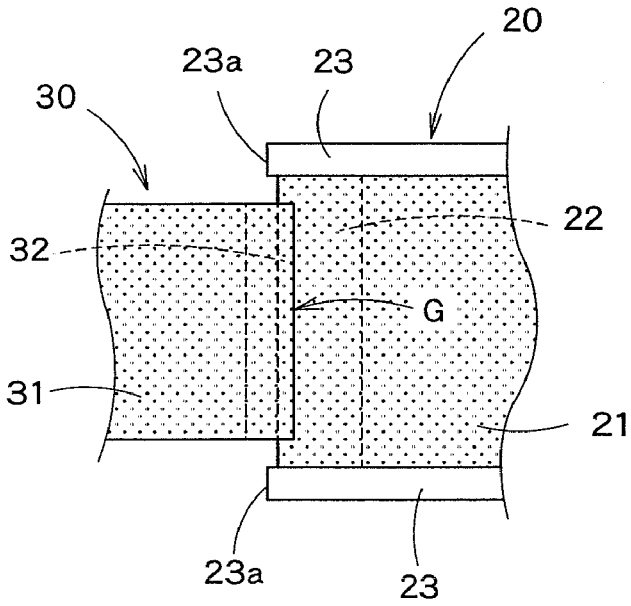
FIG. 8 is an enlarged illustration of a contact portion of the feed roller and a press-fitting roller in the paper-sheet storing and feeding device in FIG. 1.

As shown in FIGS. 7 and 8, a pair of flanges 23 formed from, for example, a plastic, are attached to both sides of each combined body of the rubber 22 and base part 21. As shown in FIG. 8, each flange 23 includes a protrusion part 23*a* further protruding, for example, 0.2 mm, outwardly, in the radial direction of the feed roller 20, from the rubber 22.

The diameter of each feed roller 20 is approximately 30 mm, for example, while the width is approximately 8 mm, for example.

Each press-fitting roller 30 is provided to press-fit against each corresponding feed roller 20. The press-fitting roller 30, as shown in FIG. 7, includes a base part 31 having a substantially disk-like shape and formed from, for example, a plastic or metal, and a rubber (or high friction part) 32 formed over the entire outer circumference of the base part 31.

The rubber 32 of each press-fitting roller 30 provides the gate part G (or nip) between the rubber 32 and the rubber 22 of each corresponding feed roller 20. As shown in FIG. 8, the width of the rubber 32 of each press-fitting roller 30 is designed to be slightly narrower than the width of the rubber 22 of each feed roller 20.

Each press-fitting roller 30 includes a torque-limiting unit (not shown) therein. Thus, when there is no paper-sheet between the feed rollers 20 and the press-fitting rollers 30, proper torque greater than predetermined torque will be applied to each press-fitting roller 30, such that the press-fitting roller 30 can be rotated together with each corresponding feed roller 20. On the other hand, when there is one or more paper-sheets between the feed rollers 20 and the press-fitting rollers 30, only a torque less than the predetermined torque will be applied to each press-fitting roller 30, as such the rotation of the press-fitting roller 30 will be stopped, by force, due to the torque-limiting unit. Consequently, only one paper-sheet that is in contact with the feed rollers 20 can be fed by rotation of the feed rollers 20, thereby preventing a plurality of paper-sheets from being fed together, at a time, through the gate part G.

As stated above, since the press-fitting type gate part G is provided between the feed rollers 20 and the press-fitting rollers 30, the paper-sheet P to be fed due to the feed rollers 20 can be separated into one sheet.

The diameter of each press-fitting roller 30 is approximately 26 mm, for example, while the width is approximately 6 mm, for example.

A one-way clutch (not shown), as a holding part for holding the press-fitting rollers 30, is connected with the press-fitting rollers 30. The provision of the one-way clutch enables the fitting-rollers 30 to rotate freely without being subjected to any effect from the torque-limiting unit, when the paper-sheet is fed therein.

The paper-sheet holding unit 40 can be optionally advanced to and retracted from the kicker rollers 10 on the table 45 (i.e., can be moved in both of the left and right directions in FIG. 1), the forward advance of the paper-sheet holding unit 40 toward the kicker rollers 10 causes the plurality of paper-sheets to be held between the paper-sheet holding unit 40 and the kicker rollers 10, while being arranged in a standing state.

On the surface of the paper-sheet holding unit 40 opposed to the kicker rollers 10 is attached a rubber (or high friction part) 41 configured to be in contact with the surface a rear-most paper-sheet of the plurality of paper-sheets stacked on the table 45. When the paper-sheet holding unit 40 is advanced, the rubber 41 will press the plurality of stacked paper-sheets forward (or in the right direction in FIG. 1) so as to bring them into a standing position.

It should be appreciated that the part attached to the surface of the paper-sheet holding unit 40 on the side of the kicker rollers 10 is not limited to a rubber 41, but any other suitable units may be used, provided that they have friction force greater than that to be effected between the paper-sheets.

Figure 9:
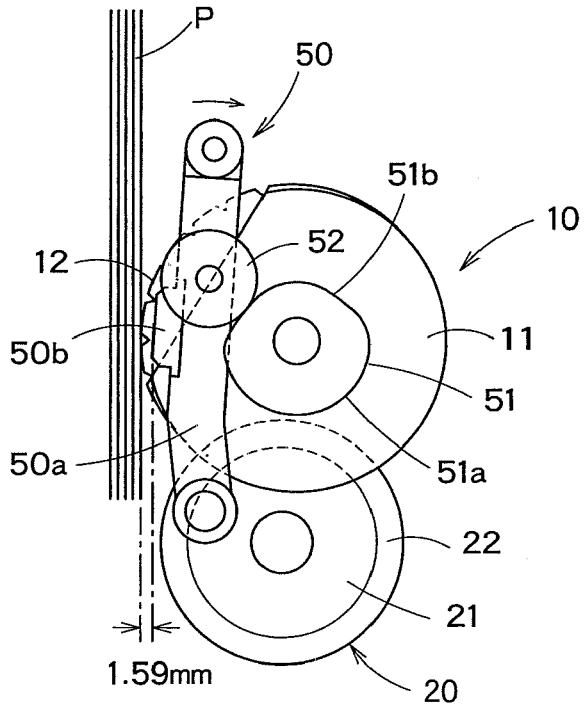
FIG. 9 is a side view showing a state of stoppers and a stopper-operating cam in the paper-sheet storing and feeding device in FIG. 1, upon kicking out a paper-sheet.
Figure 10:
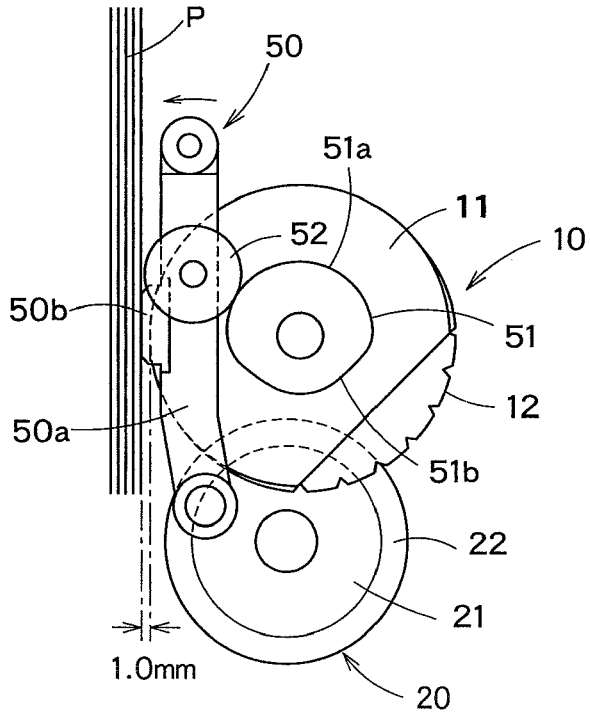
FIG. 10 is a side view showing a state of the stoppers and stopper-operating cam in the paper-sheet storing and feeding device in FIG. 1, upon holding the paper-sheet.

The stopper 50, as shown in FIGS. 1 and 2, is provided in the vicinity of the kicker rollers 10, and is configured to be advanced to and retracted from the forefront paper-sheet P held in a stacked state on the table 45. The stopper 50 has hollow portions (see FIG. 2), which respectively open in the advancing and retracting directions so as not to collide with the respective kicker rollers 10 upon the actuation. Thus, when the stopper 50 is moved, the kicker rollers 10 will pass through the hollow openings, relatively. The stopper 50, as shown in FIGS. 9 and 10, includes stopper levers 50*a* respectively configured to be advanced to and retracted from the forefront paper-sheet P, and stopper rubbers (or high friction parts) 50*b* attached to a face of each stopper lever 50*a* opposed to the paper-sheet P (or on the left side thereof in FIG. 9). FIG. 9 is a side view showing a state of each stopper 50 and a stopper-operating cam 51, upon kicking out the paper-sheet, and FIG. 10 is a side view showing a state of each stopper 50 and the stopper-operating cam 51, upon holding the paper-sheet.

Each stopper lever 50*a* is pivotally supported, at its bottom end, at a point in the vicinity of the axis of each feed roller 20, and extends upward from the bottom end, such that it can swing both in the left and right directions in FIG. 9 about its pivotally supported bottom end. To each stopper lever 50*a*, biasing force is always applied from a retracting unit (not shown), such as a spring, for urging the lever 50*a* to be spaced away from the paper-sheet P (or to move it in the right direction in FIG. 9). Thus, unless applying sufficient force to the stopper 50 in order to urge it to advance toward the paper-sheet P due to the stopper-operating cam 51 which will be described later, each stopper lever 50*a* tends to be rotated, about its bottom end, so as to move away from the paper-sheet P (or in the right direction in FIG. 9).

Each stopper rubber 50*b* is attached to each stopper lever 50*a* around its central position, while projecting toward the paper-sheet P (in the left direction in FIG. 9) from the stopper lever 50*a*. As shown in FIG. 2, two, i.e., left and right, stopper rubbers 50*b* are attached to the single stopper 50.

As shown in FIG. 9, a circular rotary plate 52 is rotatably attached to a side face slightly above the central position of the stopper 50.

The stopper 50 is configured such that, upon kicking out the paper-sheet P due to the kicker rollers 10, each stopper lever 50*a* retracts from the forefront paper-sheet P (see FIG. 9), so that each stopper rubber 50*b* can be positioned not to contact with the forefront paper-sheet P. At this time, as shown in FIG. 9, each stopper rubber 50*b* of the stopper 50 is retracted, for example, 1.59 mm, from the outer circumferential face of the kicker rollers 10, relative to the surface of the paper-sheet P.

Furthermore, the stopper is configured such that, upon not kicking out but holding the paper-sheet P placed on the table 45, each stopper lever 50*a* is advanced to the forefront paper-sheet P (see FIG. 10), so that each stopper rubber 50*b* can contact with the forefront paper-sheet P and press the forefront paper-sheet P backward (in the left direction in FIG. 10). At this time, as shown in FIG. 10, each stopper rubber 50*b* of the stopper 50 is advanced, for example, 1 mm, from the outer circumferential face of the kicker rollers 10, relative to the surface of the paper-sheet P.

The stopper-operating cam 51, as shown in FIGS. 9 and 10, is attached coaxially with the kicker rollers 10, and rotated synchronously with the kicker rollers 10. The stopper-operating cam 51 is of a disk-like shape, in which the outer circumferential face includes a first outer circumferential face 51*a* having a semicircular cross section and a second outer circumferential face 51*b* each defining the distance from the rotary axis to be less than the radius of the first outer circumferential face 51*a*.

As shown in FIGS. 9 and 10, the outer circumferential face of the stopper-operating cam 51 is configured to be in contact with the outer circumferential face of the rotary plate 52 rotatably provided to the stopper 50. Specifically, during a period of time, from a kicking out start timing at which the rubber 12 of each kicker roller 10 starts to contact with at least the forefront paper-sheet P to a kicking out end timing at which the forefront paper-sheet P is kicked out and spaced apart from the rubber 12, the outer circumferential face of the rotary plate 52 is in contact with the second outer circumferential face 51*b* in the outer circumferential face of the stopper-operating cam 51 (see FIG. 9). Meanwhile, during a period of time from the aforementioned kicking out end timing to a next kicking out start timing, the outer circumferential face of the rotary plate 52 is in contact with the first outer circumferential face 51*a* in the outer circumferential face of the stopper-operating cam 51 (see FIG. 10).

In the case where the first outer circumferential face 51*a* of the stopper-operating cam 51 is in contact with the outer circumferential face of the rotary plate 52, the rotary plate 52 can be moved closer to the paper-sheet P as compared with the case where the second outer circumferential face 51*b* is in contact with the outer circumferential face of the rotary plate 52. Thus, in the case where the second outer circumferential face 51*b* of the stopper-operating cam 51 is in contact with the outer circumferential face of the rotary plate 52, each stopper rubber 50*b* of the stopper 50 is retracted from the outer circumferential face of each kicker roller 10 relative to the paper-sheet P. However, in the case where the first outer circumferential face 51*a* of the stopper-operating cam 51 is in contact with the outer circumferential face of the rotary plate 52, each stopper rubber 50*b* of the stopper 50 is advanced from the outer circumferential face of each kicker roller 10 toward the paper-sheet P.

Next, the operation of the embodiment constructed as described above will be discussed.

First, the operation for successively feeding the plurality of paper-sheets held in a stacked standing state, to the outside, one sheet for each operation, will be described.

Initially, the plurality of paper-sheets is placed on the table 45 between the paper-sheet holding unit 40 and the kicker rollers 10. The paper-sheet holding unit 40 is then advanced toward the kicker rollers 10 (or moved in the right direction in FIG. 1), so as to hold them between the paper-sheet holding unit 40 and the kicker rollers 10 and bring them into a standing state.

To the paper-sheet holding unit 40, proper force is applied from behind so as to always cause the holding unit 40 to be advanced toward the kicker rollers 10 on the table 45. Therefore, even after some of the paper-sheets held in a stacked state are kicked out by the kicker rollers 10, the remaining paper-sheets can be always kept in a standing state.

After the plurality of paper-sheets are stacked in a standing state due to the paper-sheet holding unit 40, the kicker rollers 10 and the feed rollers 20 are rotated continuously in the directions depicted by the arrows shown in FIG. 1, respectively. In this case, the stopper-operating cam 51 coaxially attached to the axis of the kicker rollers 10 is also rotated continuously and synchronously with the kicker rollers 10.

The continuous rotation of the kicker rollers 10 brings each rubber 12 into contact with the forefront paper-sheet P of the plurality of stacked paper-sheets, as such kicking out the forefront paper-sheet P to the downstream.

In this case, during a period of time, from the kicking out start timing at which the rubber 12 of each kicker roller 10 starts to contact with the forefront paper-sheet P to the kicking out end timing at which the forefront paper-sheet P is kicked out and spaced apart from the rubber 12, the outer circumferential face of the rotary plate 52 pivotally supported by the stopper 50 is in contact with the second outer circumferential face 51*b* of the stopper-operating cam 51 (see FIG. 9). Therefore, since each stopper rubber 50*b* of the stopper 50 is retracted from the outer circumferential face of the kicker rollers 10 relative to the paper-sheet P, there is no risk that the forefront paper-sheet P is locked by the stopper 50.

Meanwhile, during a period of time after the forefront paper-sheet P is kicked out due to the rubber 12 of each kicker roller 10 and until the rubber 12 will contact with a next paper-sheet after further rotation of the kicker roller 10, the outer circumferential face of the rotary plate 52 pivotally supported by the stopper 50 is in contact with the first outer circumferential face 51*a* of the stopper-operating cam 51 (see FIG. 10). Therefore, since each stopper rubber 50*b* of the stopper 50 is advanced from the outer circumferential face of the kicker rollers 10 toward the paper-sheet P, the next paper-sheet can be locked by the stopper 50, thereby to prevent securely a plurality of paper-sheets from being fed together, at a time, through the kicker rollers 10.

As shown in FIGS. 3 and 4, at the boundary point 15 between the base part 11 and the rubber 12 in the outer circumferential face of each kicker roller 10, there is substantially no difference in levels between the central portion 11*b* of the base part 11 and the rubber 12. Therefore, vibration of the paper-sheet P to be generated upon starting the contact of the rubber 12 with the forefront paper P held in a stacked state can be reduced. On the other hand, since there is some difference in levels between the edge portions 11*a* of the base part 11 and the rubber 12 at the boundary point 15, significant edge effect can be securely obtained upon kicking out the paper-sheet P due to the rubber 12.

In this manner, the plurality of paper-sheets held in a stacked state on the table 45 can be kicked out, intermittently, toward the feed rollers 20 provided on the subsequent stage, successively, one sheet for each operation, due to the kicker rollers 10.

The paper-sheet kicked out to the downstream from the kicker rollers 10 is then carried into the gate part G (or nip) provided between the rubbers 22 of the feed rollers 20 and the rubbers 32 of the press-fitting rollers 30, and the paper-sheet carried into the gate part G will be further fed due to the feed rollers 20, successively, one sheet for each operation. In this case, since the press-fitting rollers 30 are each configured to press-fit against each corresponding feed roller 20, when there is no paper-sheet between the feed rollers 20 and the press-fitting rollers 30, a proper torque greater than predetermined torque will be applied to each press-fitting roller 30, such that the press-fitting roller 30 can be rotated together with each corresponding feed roller 20, thus rotating in the direction depicted by an arrow in FIG. 1. On the other hand, when there is one or more paper-sheets between the feed rollers 20 and the press-fitting rollers 30, only the torque less than the predetermined torque will be applied to each press-fitting roller 30, as such the rotation of the press-fitting roller 30 will be stopped, by force, due to the torque-limiting unit. Consequently, only one paper-sheet that is in contact with the feed rollers 20 can be fed by rotation of these feed rollers 20, thereby preventing a plurality of paper-sheets from being fed together, at a time, through the gate part G.

As shown in FIGS. 7 and 8, each feed roller 20 has flanges 23 on its both sides, and each flange 23 projects further radially outward from each rubber 22. Thus, resistance against the advancement of the paper-sheet into the gate part G can be increased, thereby to further securely prevent a plurality of paper-sheets from being fed together, at a time, through the gate part G. In addition, since each flange 23 projects further radially outward from each rubber 22, failure of feeding at the gate part G will not occur, even in the case where the paper-sheet to be carried through the gate part G is an unusual one, for example, those having a folded distal end or the like.

The paper-sheet fed out from the gate part G between the feed rollers 20 and the press-fitting rollers 30 is then carried along the guide unit 29 due to the first grip rollers 25 and the second grip rollers 26, and finally carried out from the nip provided between the third grip rollers 27 and the carrying out rollers 28.

Next, the operation for storing the plurality of paper sheets to be fed in successively from the outside and for bringing them into a stacked state will be discussed with respect to the paper storing and feeding device of the embodiment described above.

First, the paper-sheet is inserted between the third grip rollers 27 and the carrying out rollers 28, one sheet for each operation. The paper-sheet inserted is then carried to the gate part G provided between the feed rollers 20 and the press-fitting rollers 30 along the guide unit 29. In this case, the feed rollers 20 are rotated continuously in the direction reverse to the arrow depicted in FIG. 1.

The paper-sheet carried to the gate part G is further fed into the device due to the feed rollers 20, one sheet for each operation. At this time, since the press-fitting rollers 30 are each configured to press-fit against each corresponding feed roller 20, stabilized grip can be ensured at the gate part G. Additionally, since the one-way clutch is employed as a holding part for holding the press-fitting rollers 30, the press-fitting rollers 30 can be rotated freely without undergoing any effect of the torque-limiting unit upon feed-in of each paper-sheet. As a result, the press-fitting rollers 30 will serve as a pinch roller.

Each paper sheet fed into the device due to the feed rollers 20 is then carried onto the table 45, successively. Thereafter, the resultant plurality of paper-sheets carried and stacked on the table 45 are held between the paper-sheet holding unit 40 and the kicker rollers 10, as such being brought into a standing state.

At this time, since each feed roller 20 includes the flanges 23 provided on both sides of each rubber 22 and projecting further radially outward from the rubber 22, each paper-sheet, when stored in the device, will take, for example, a wave-like shape having a curved cross section, upon passing through the gate part G, as such increasing strength of rigidness. Therefore, upon stacking the paper-sheets on the table 45, they can be stacked stably due to the increase of strength of rigidness in each paper-sheet to be fed thereon.

As stated above, according to the paper-sheet storing and feeding device of this embodiment, the rubber (or high friction part) 12 is formed in a part of the outer circumference of the base part 11 of each kicker roller 10 along the circumferential direction, as well as the rubber 22 (or high friction part) 22 is formed over the entire outer circumference of the base part 21 of each feed roller 20. In addition, the press-fitting type gate part G, which is adapted to separate the paper-sheets to be fed due to the feed rollers 20 into one sheet for each operation, is provided between the feed rollers 20 and the press-fitting rollers 30. Consequently, the paper-sheets held in a stacked state can be fed out by the kicker rollers 10, successively, one sheet for each operation, without being subjected to the effect due to the thickness or strength of rigidness of each paper-sheet. Thereafter, by passing them, one after another, through the press-fitting type gate part G, they can be fed out, securely and successively, one sheet for each operation, without being affected by the thickness or strength of rigidness of each paper-sheet. Thus, there should be no need for adjusting the gate part, corresponding to various sorts and/or denominations of paper-sheets, e.g., banknotes of various countries, having various thickness and strength of rigidness, and hence such paper-sheets can be fed, securely, one sheet for each operation, without feeding it together with a second or more later ones at a time, thus enabling to provide secure counting of the number of paper-sheets to be fed.

According to such a paper-sheet storing and feeding device, the feed-in and feed-out of the paper-sheets can be performed utilizing the same carrying route, thus downsizing the paper-sheet storing and feeding device.

While the above embodiment has been described with respect to the paper-sheet storing and feeding device adapted to feed in and feed out the paper-sheets, this invention is not limited to such an aspect. For instance, the present invention can also be applied to the paper-sheet feeding device which has no function to feed in and store the paper-sheets, but is only adapted to feed out the paper-sheets, successively, one sheet for each operation.

It should be appreciated that the paper-sheet storing and feeding device according to the present invention is not limited to the aspect described above, and that various modifications can be made thereto.

Figure 11:
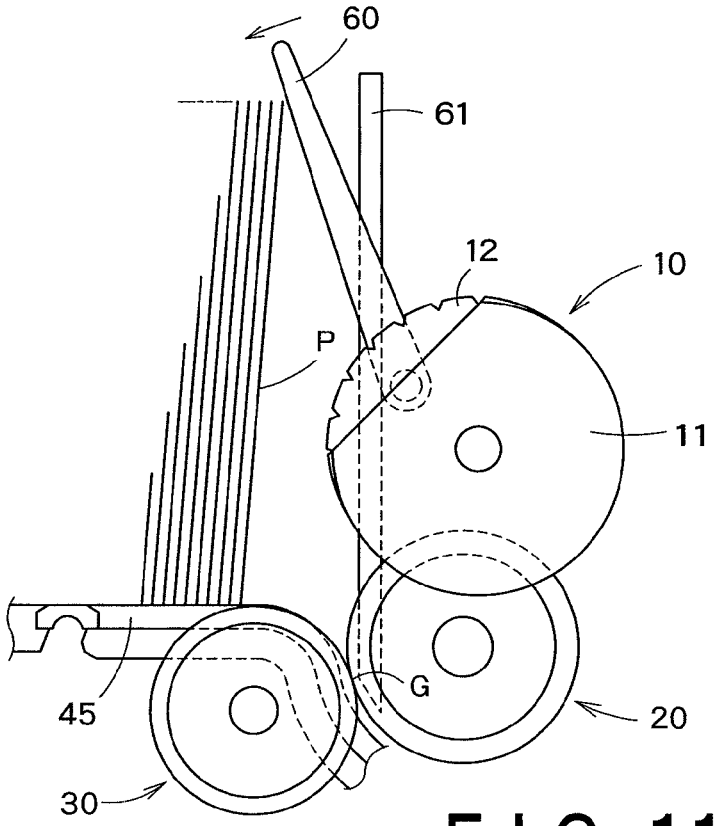
FIG. 11 is a side view showing details of a construction of a movable slope unit in the modified paper-sheet storing and feeding device.
Figure 12:
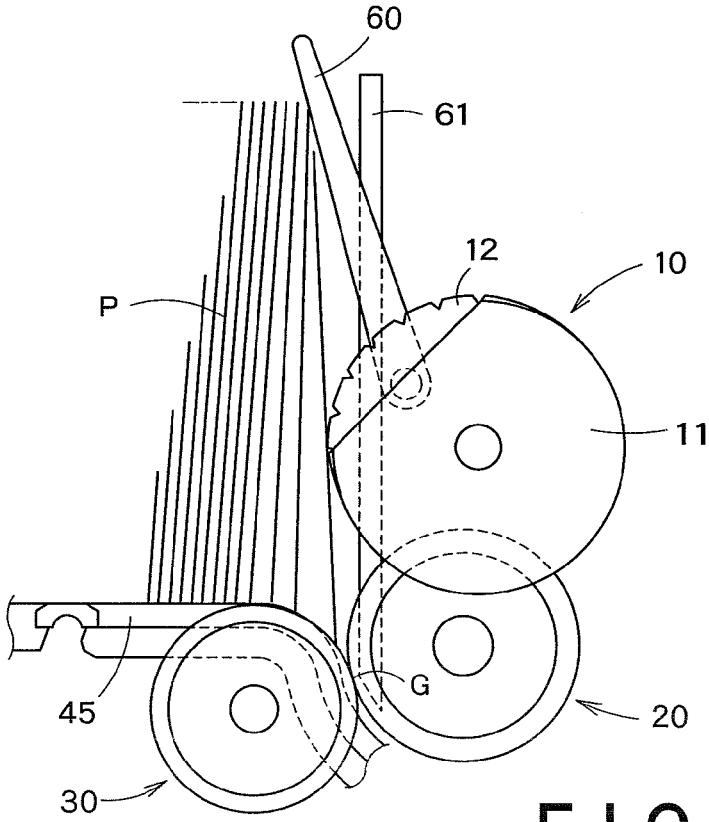
FIG. 12 is a side view showing the construction of the movable slope unit in FIG. 11 upon kicking out the paper-sheet.

Now, the modifications for the paper-sheet storing and feeding device according to the present invention will be described with reference to FIGS. 11 and 12. In FIGS. 11 and 12, like reference numerals are assigned to like parts as having been described in the embodiment shown in FIGS. 1 to 10, respectively, and such parts will not be detailed below.

As shown in FIG. 11, a movable slope unit (or pusher) 60 may be provided in the vicinity of the kicker rollers 10, wherein the slope unit 60 is adapted to press, backward (i.e., in the direction in FIG. 11), an upper end of the forefront paper-sheet P of the plurality of paper-sheets stacked on the table 45, so as to keep these paper-sheets in a standing state. It should be appreciated that the pusher for pushing backward the upper end of the forefront paper-sheet P on the table 45 is not limited to the movable slope unit 60 as described above, but may be of another type, for example, a stationary-type unit.

The movable slope unit 60 is pivotally supported, at its bottom end, in the vicinity of the axis of the kicker rollers 10, and extends forward and upward (i.e., in the left upper direction in FIG. 11) from the bottom end toward the paper-sheet P. The movable slope unit 60 is configured to swing both in the left and right directions in FIG. 11 about its pivotally supported bottom end. In this case, the movable slope unit 60 is biased by, for example, a spring (not shown), such that it will go down toward the paper-sheet P (i.e., in the direction depicted by an arrow in FIG. 11). Therefore, the movable slope unit 60 tends to be in contact with the upper end of the forefront paper-sheet P of the plurality of paper-sheets stacked on the table 45 as shown in FIG. 11, thus pressing backward the upper end of the forefront paper-sheet P.

Additionally, as shown in FIG. 11, a guide unit 61 extending upward is fixedly provided in the vicinity of the kicker rollers 10, such that it faces the forefront paper-sheet P.

Next, the operation of this modification having the construction as described above will be discussed. However, the same operation as in the embodiment having been described with reference to FIGS. 1 to 10 will be omitted here.

Upon the feed-out of the paper-sheets, the paper-sheets sometimes do not assume a completely standing position but will be inclined toward the kicker rollers 10 when the plurality of paper-sheets are initially placed on the table 45 between the paper-sheet holding unit 40 and the kicker rollers 10. Furthermore, while the paper-sheets are successively carried out due to the kicker rollers 10, the paper-sheets on the table 45 are pushed forward (i.e., toward the kicker rollers 10), due to the paper-sheet holding unit 40. In this case, however, the paper-sheets sometimes go down from the standing position and will be inclined forward while being pushed, because significant friction force may be in effect between the bottom end of each paper-sheet and the surface of the table 45.

Therefore, some biasing force is applied to the movable slope unit 60 due to the aforementioned spring such that the slope unit 60 can go down toward the paper-sheet P. As such, the upper end of the forefront paper-sheet P can be pressed backward due to the movable slope unit 60, thereby the plurality of sheet-papers are forwardly inclined on the table 45 taking a standing state.

Next, with the continuous rotation of the kicker rollers 10, each rubber 12 can be in contact with the forefront paper-sheet P of the stacked plurality of paper-sheets, as such kicking out the forefront paper-sheet P downstream. In this way, the plurality of paper-sheets stacked on the table 45 can be kicked out, intermittently, toward the feed rollers 20 provided on the subsequent stage, successively, one sheet for each operation, due to the kicker rollers 10 (see FIG. 12). At this time, since the movable slope unit 60 is provided to extend forward and upward toward the paper-sheet P, occurrence of a greater gap (space) between the paper-sheets and the feed rollers 20 can be prevented, as shown in FIG. 12. Accordingly, occurrence of failed feeding and folding of a distal end of each paper-sheet can be prevented at the gate part G.

Specifically, if the movable slope unit 60 is not provided, some of the plurality of paper-sheets placed on the table 45 would be inclined forwardly toward the kicker rollers 10, resulting in a greater gap or space between the bottom ends of the paper sheets on the table 45 and the feed rollers 20. Thus, the forefront paper-sheet P to be kicked out by the kicker rollers 10 may be stopped or captured due to such a gap, as such it can not be fed directly to the gate part G. In addition, there is a risk that such a gap may cause folding at a distal end of each paper-sheet R Meanwhile, in the present invention, due to the provision of the movable slope unit 60, the size of the gap to be created between the bottom ends of the paper-sheets on the table 45 and the feed rollers 20 can be significantly lessened, as compared with the case in which the movable slope unit 60 is not provided. Accordingly, the jamming of the paper-sheet P and/or folding at the distal end of each paper-sheet P, due to the gap, can be prevented.

Furthermore, since the movable slope unit 60 is inclined forward and upward toward the paper-sheet P, the point at which the movable slope unit 60 is in contact with the paper-sheet P is only the upper end portion of the paper-sheet P all the time the paper-sheet P is kicked out by the kicker rollers 10 and then fed to the gate part G.

As described above, according to the modification of the paper-sheet storing and feeding device, the movable slope unit (or pusher) 60 can serve to press backward the upper end of the forefront paper-sheet P so as to keep the paper-sheets in a standing state. Thus, the size of the gap to be created between the bottom end of the forefront paper-sheet P and the feed rollers 20 can be lessened. Accordingly, the jamming of the paper-sheet P to be kicked out by the kicker rollers 10 at the gap, and/or folding of the distal end of each paper-sheet P at the gap, can be prevented. Since the point at which the movable slope unit 60 is in contact with the forefront paper-sheet P is only the upper end portion thereof, the surface of the forefront paper-sheet P will not be subjected to greater resistance from the guide unit 61, thus preventing occurrence of failed feeding of the paper-sheets at the gate part G.

The invention claimed is:

1. A paper-sheet feeding device, comprising:

a kicker roller in contact with the surface of a forefront paper-sheet of a plurality of paper-sheets held in a stacked state, the kicker roller being rotated continuously upon performing feed-out of the paper-sheets such that the kicker roller kicks out paper sheets one by one intermittently;

a feed roller rotated continuously upon performing the feed-out of the paper-sheets, and including a feed roller base part and a feed roller friction part formed over the entire outer circumference of the feed roller base part, the feed roller friction part being in contact with the surface of the paper-sheet to be kicked out by the kicker roller so as to perform the feed-out of the paper-sheet; and a press-fitting roller provided to press-fit against the outer surface of the feed roller so as to form a compressed press-fitting gate part between the press-fitting roller and the feed roller, the gate part separating the paper-sheets to be fed by the feed roller into one sheet, the one sheet being fed through the gate part, and the press-fitting roller being rotated together with the feed roller when there is no paper-sheet between the feed roller and the press-fitting roller.

2. The paper-sheet feeding device according to claim 1, further comprising:

a stopper that is advanced to and retracted from the forefront paper-sheet, wherein, when advanced, the stopper is actuated to press against the forefront paper-sheet so as to make the kicker roller detach from the forefront paper-sheet, while when retracted, the stopper is actuated to make the kicker roller be in contact with the forefront paper-sheet; and a stopper-operating cam that is rotated synchronously with the kicker roller and that retracts the stopper during a period of time, from a kicking out start timing at which a kicker roller friction part of the kicker roller starts to contact with at least the forefront paper-sheet to a kicking out end timing at which the forefront paper-sheet is kicked out and spaced apart from the kicker roller friction part of the kicker roller, as well as making the stopper advance during a period of time, from the kicking out end timing to a next kicking out start timing.

3. The paper-sheet feeding device according to claim 1, wherein the kicker roller has a kicker roller friction part that kicks out the forefront paper-sheet, and wherein at least one of two edges of the kicker roller along a width direction thereof is depressed with respect to a center part of the kicker roller at a position adjacent to and anterior to the kicker roller friction part along a rotation direction of the kicker roller, so that a difference in levels is provided between the edge portions of the base part.

4. The paper-sheet feeding device according to claim 1, wherein the feed roller includes a protrusion part projecting further radially outward from the feed roller friction part on one or both sides of the feed roller friction part.

5. The paper-sheet feeding device according to claim 1, further comprising a pusher for pressing an upper end of the forefront paper-sheet backward so as to keep the paper-sheets in a standing state, such that a plurality of paper-sheets are held in a standing state along a horizontal direction and fed out downwardly.

* * * * *